United States Patent [19]

Spross et al.

[11] Patent Number: 4,832,536

[45] Date of Patent: May 23, 1989

[54] ANCHOR DRILLING UNIT

[75] Inventors: Erhard Spross, Neunkirch; Hans-Rudolf Ruttimann, Rafz; Gunter Straub, Schleitheim, all of Switzerland

[73] Assignee: Sig Schweizerische Industrie-Fesellschaft, Neuhausen am Rheinfall, Switzerland

[21] Appl. No.: 112,270

[22] Filed: Oct. 26, 1987

[30] Foreign Application Priority Data

Nov. 7, 1986 [CH] Switzerland ..... 4453/86

[51] Int. Cl.[4] ..... E21D 11/00

[52] U.S. Cl. ..... 405/303; 173/22; 173/39; 405/259; 405/260

[58] Field of Search ..... 405/259, 260, 261, 303; 173/22, 39, 46; 175/52, 85, 220, 315

[56] References Cited

U.S. PATENT DOCUMENTS

| | | | |
|---|---|---|---|
| 4,158,520 | 6/1979 | Prebensen | 405/260 |
| 4,229,124 | 10/1980 | Frey et al. | 405/303 |
| 4,420,277 | 12/1983 | Hibbard et al. | 405/260 |
| 4,473,325 | 9/1984 | Beney et al. | 405/303 |
| 4,588,037 | 5/1986 | Cambet | 175/220 |

FOREIGN PATENT DOCUMENTS 2657650 7/1977 Fed. Rep. of Germany .

*Primary Examiner*—David H. Corbin

*Attorney, Agent, or Firm*—Lewis H. Eslinger; Jay H. Maioli

[57] ABSTRACT

An anchor drilling unit for use in rock bolting includes a rock drill with chuck traveling along a carriage, which drilling unit is improved by a special tool exchange device that can move parallel to the carriage and can also rotate relative to the rock drill. The tool exchange device includes a base support arranged parallel to the carriage and upper and lower carrier plates with releasable retaining elements for selectively retaining a drill rod, an anchor bar, and a cartridge tube used for injecting resin into the bore hole in a tunnel roof. The rod, bar, and tube can be aligned coaxially with the rock drill axis by turning the exchange device and each have lower ends adapted for cooperation with the chuck of the single rock drill. When setting an anchor, a hole is first bored using the drill rod and rock drill and the hole is filled with resin from the cartridge tube by injecting adhesive cartridges using wash water and finally an anchor bar is inserted through a support plate that has been placed against the roof of the tunnel. A nut is threaded on the end of the anchor rod and the support plate is tightened securely to the roof.

20 Claims, 7 Drawing Sheets

ANCHOR DRILLING UNIT

BACKGROUND OF THE INVENTION

1. Field of the Invention

This invention relates generally to an apparatus for anchoring roof support plates to the roof of an underground construction and, more particularly, to apparatus for drilling the hole for the anchor rod, for filling the hole with a resin, and for inserting the anchor rod in the hole to secure the roof support plate.

2. Description of the Background

The technique of roof bolting or rock bolting as an alternative to conventional timbering for securing the roof of tunnels and mining excavations is known. In fact, specially designed operating units are presently available to accomplish the anchoring of roof support plates by rock bolting. In one of these known machines, an operating unit drills a bore hole in the roof and places an adhesively retained anchor in the drill hole. In such machine a sled is moveable longitudinally on a carriage and the sled carries a further transverse sled on which a rock drill and an anchor placement machine are mounted. A rotatable guide element that includes guides for the drill rod and the anchor as well as the feed hose for pneumatically blowing-in adhesive cartridges is located at the front end of the carriage of the sled. The rear end of the carriage includes elements for pressing a support plate against the roof to set an anchor rod therein.

In the operation of this previously known system, the guide element and the transverse sled are first moved so that the rock drill is aligned with the drill rod guide and then the bore hole is drilled in the roof using the rock drill. After withdrawal of the drill rod, the tube end is swung beneath the bore hole and the cartridges containing the adhesive are blown in with compressed air. Finally, the transverse sled and the guide element are moved so that the anchor placement machine that includes the anchor attached thereto is aligned with the bore hole. The anchor is then introduced and seated in the bore hole, where it is retained by the adhesive.

Although use of this known anchor drilling machine does make it possible to secure support plates to the roof of an underground excavation without employing manual labor to perform every step, the use of this automated machine is, nevertheless, tedious and requires much setting up and skill in operation. In addition, because of the separate units employed considerable space is required for this machine and, for that reason, it is not suitable for the simultaneous placement of a large number of anchor rod into a support plate at one time.

In addition to the anchor drilling unit described above, other anchor drilling units are known, such as those in U.S. Pat. No. 4,158,520, U.S. Pat. No. 4,588,037, and in Published German Pat. No. 2,657,650. Nevertheless, these previously known rock bolting or anchor drilling units also suffer from at least the above-mentioned disadvantages.

OBJECTS AND SUMMARY OF THE INVENTION

Accordingly, it is an object of the present invention to provide an anchor drilling unit for use in securing support plates to a roof of an excavation that can eliminate the above-noted defects inherent in the prior art.

Another object of the present invention is to provide an anchor drilling unit that is compact and can contain an anchor rod, an adhesive cartridge tube insertion device, and a drill rod in a compact unit that requires only a single rock drill.

A further object of the present invention is to provide an anchor drilling unit in which the adhesive cartridges are inerted into the bore hole by means of controllable hydraulic pressure to reduce then risk that the adhesive cartridges are ruptured during insertion.

In accordance with an aspect of the present invention, an anchor drilling unit is provided that includes a rock drill having a chuck that can receive an end of either the drilling rod, the anchor rod, or the adhesive cartridge inserting tube. A rotary tool exchange device is provided that can align the appropriate tool and the center line of the chuck. The exchange device is arranged to move around the periphery of the rock drill, so that upon rotation the appropriate tool can be aligned with the chuck. Uptake elements and tensioning devices are provided to cooperate with the drill rod and the anchor rod on the exchange device and can be operated independently depending upon the tool presently being used. The chuck of the rock drill is provided with a water inlet so that, by utilizing a hollow drill rod, water can be introduced into the bore hole. Similarly, by employing this rock drill and chuck connected to a water source, water pressure can be used to propel the adhesive cartridges into the bore hole.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

Figure 1:
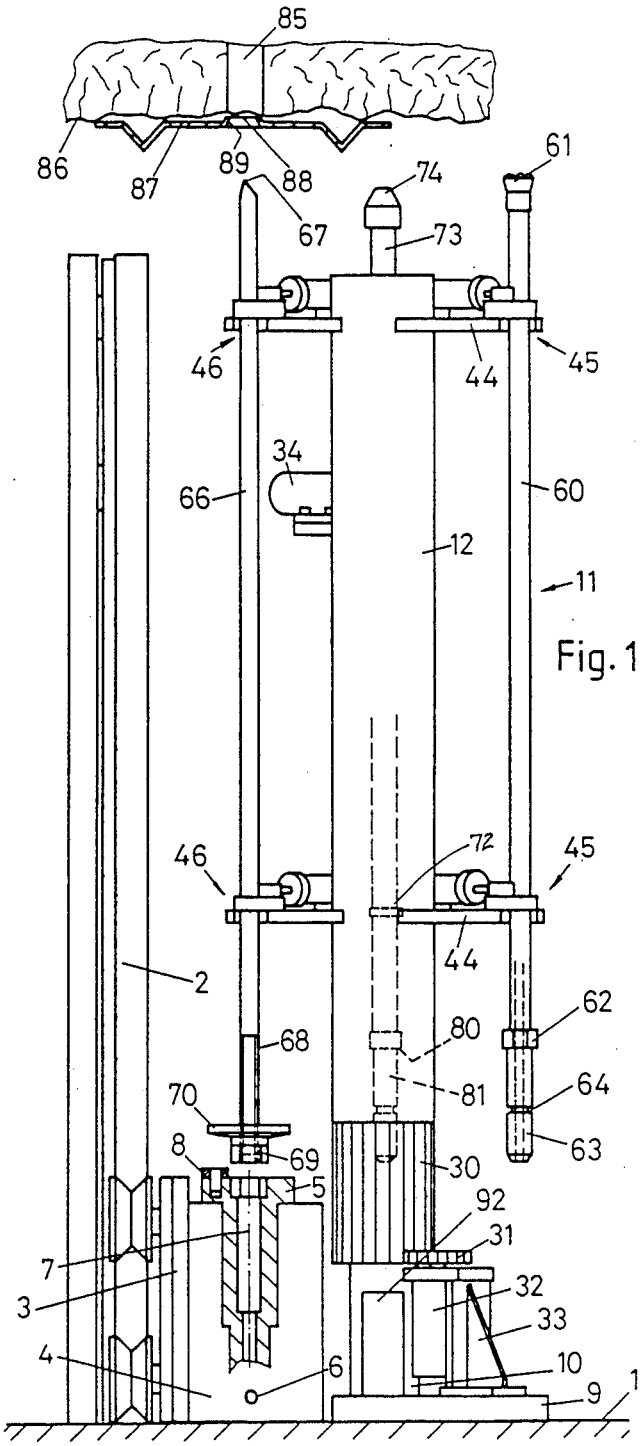
FIG. 1 is a schematic representation of an anchor drilling unit according to the present invention.

Referring now to FIG. 1, the anchor drilling unit is seen in a side elevational view mounted on a platform 1 of a demolition or excavation machine (not shown) used for underground excavation, such as tunnel construction or mining. A telescoping vertical carriage 2 is attached to platform 1 of the demolition machine and a sled 3 is mounted for vertical movement on the vertical carriage 2. Mounted on sled 3 is a rotary rock drill 4, such that upon driving sled 3 in a vertical direction by a suitable lifting cylinder (not shown), rock drill 4 can be utilized for drilling in the roof of the tunnel or gallery under construction. A chuck 5 is mounted on rock drill 4, which also includes a water connection 6 in the chuck 5, so that the water can be used in washing a bore hole made in the roof. A socket 8 is provided in chuck 4 for use in manually rotating chuck 5, in the event that the drill rod becomes stuck in the bore hole. Also attached to platform 1 of the underground demolition machine is a mounting plate 9 to which is firmly affixed a cylindrical, hollow bearing support 10. Mounting plate 9 and hollow bearing support 10 form part of an exchange device 11, which forms an important part of the present invention. More specifically, exchange device 11 is mounted on platform 1 to have its longitudinal axis arranged parallel to a rock drill axis 7, which is essentially the center line of rotation for chuck 5 in rock drill 4. Tool exchange device 11 includes a jacket tube 12 that is mounted for both rotation and for longitudinal movement on tubular, cylindrical hollow bearing support 10.

Figure 2:
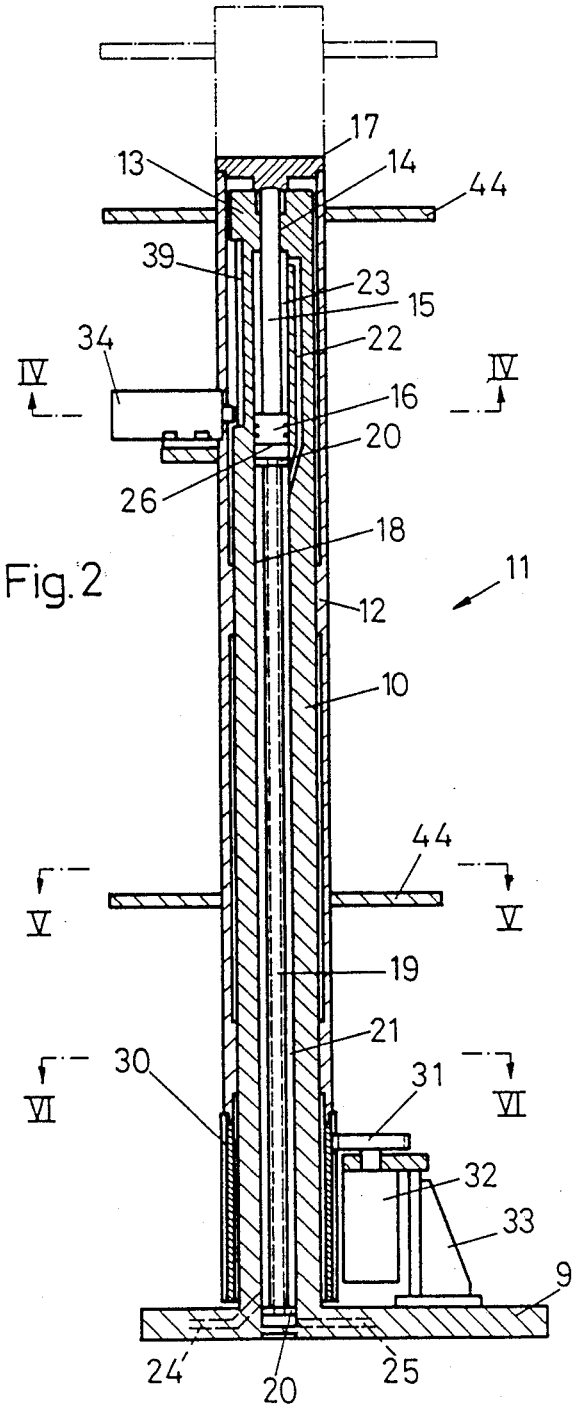
FIG. 2 is a longitudinal cross-section through a tool exchange device utilized in the anchor drilling unit of FIG. 1.

As shown in FIG. 2, hollow bearing support 10 includes a cover 13 at an uppermost end that has a central bore hole 14 through which a rod 15 of a hydraulic piston 16 can extend. Piston rod 15 is attached to the cap or cover 17 of jacket tube 12 that is firmly affixed thereto. Cylindrical, hollow bearing support 10 defines a hollow cylinder 18 on the inside thereof into which is inserted an inner tube 19, which is itself hollow. Inner tube 19 has two end flanges 20, which are sealingly engaged with the inner surface of hollow cylinder 18 formed inside the cylindrical, hollow bearing support tube 10. End flanges 20 and inner tube 19 then function as a moveable piston, with the upper end flange 20 being located slightly below the lower limit position of piston 16. Thus, inner tube 19 and cylindrical hollow bearing support 10 define a cylindrical, hollow space 21 that is connected above through a hollow channel 22 with a cylindrical space 23 that surrounds piston rod 15 and is further provided with another channel 24 for a connection to a source of pressurized hydraulic fluid. The central hollow center of inner tube 19 connects a second fluid channel 25 with the cylindrical space 26 located beneath the head end of piston 16. Thus, by application of suitable fluid and exhaust to channels 24 and 25 jacket tube 12 can be selectively raised and lowered.

In addition, jacket tube 12 includes gear teeth 30 at its lowermost end, gear teeth 30 extend over a length on jacket tube 12 that is greater than the extent of lift possible of jacket tube 12 by suitable fluid fed in and exhausted at channels 24 and 25. Gear teeth 30 at the lower end of the jacket tube 12 mesh with a pinion gear 31, which is mounted on the drive shaft of a hydraulic motor 32. Hydraulic motor 32 is attached to mounting plate 9 by a carrier bracket 33.

Figure 4:
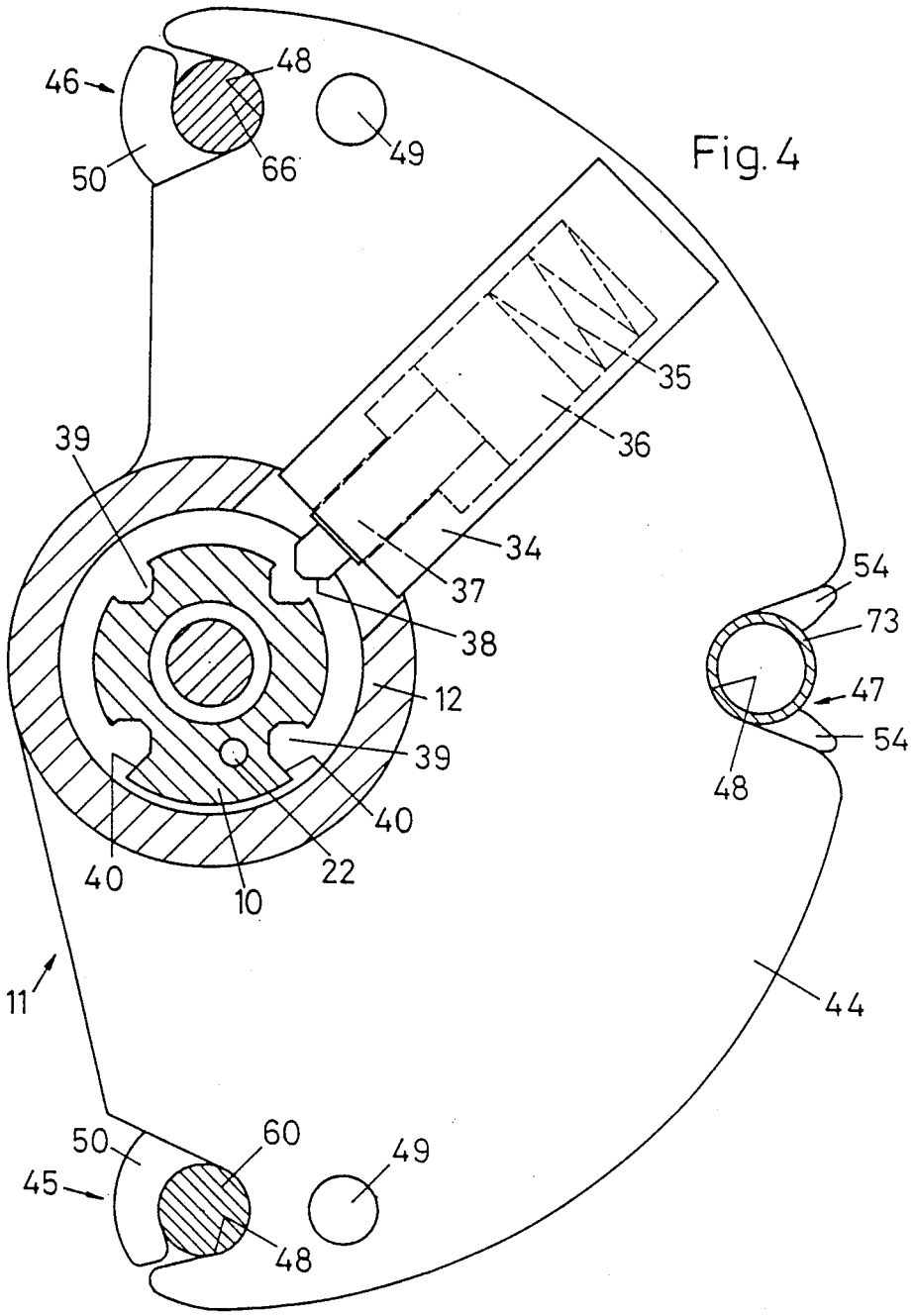
FIG. 4 is a plan view in cross section, taken along section lines IV—IV in FIG. 2.

In order to accurately control the rotary orientation of jacket tube 12 and the tools mounted thereto, an indexing cylinder 34 is provided. Indexing cylinder 34 is shown more clearly in FIG. 4 and is attached to jacket tube 12 toward the upper end thereof and includes a piston 36 that is loaded by a spring 35 to be moveable radially inwardly relative to jacket tube 12, cylindrical hollow bearing support 10, and inner tube 19, all of which are concentrically arranged. Piston 36 has a rod 37 formed therewith that has a conically shaped end 38. Conically-shaped end 38 of piston rod 37 is moved radially to cooperate with one of four similarly formed longitudinal grooves 39 in the outer surface of cylindrical hollow bearing support 10. Thus, upon action of spring 35 and no pressure applied to cylinder 34, piston rod 37 will be forced to extend radially and conical end 38 will interact with the appropriate longitudinal groove 39 formed in cylindrical hollow bearing support 10. In order to limit the rotation of cylindrical hollow bearing support 10, that is, to prevent a 360° rotation thereof. The area between two of the four grooves 39 is extended radially outwardly, so that, regardless of the retraction of piston rod 37, support tube 10 cannot rotate past the end 38 thereof. In operation, once fluid pressure is applied to piston 36 to retract radially piston rod 37, conical end 38 is brought out of contact with one of grooves 39 and tube 12 can be rotated to a new position by operation of hydraulic motor 32. Once the fluid pressure is taken off indexing cylinder 34, spring 35 moves piston 36 radially inwardly and tube 12 is exactly positioned by interaction of conical end 38 and a groove 39 in cylindrical hollow bearing support tube 10.

Figure 3:
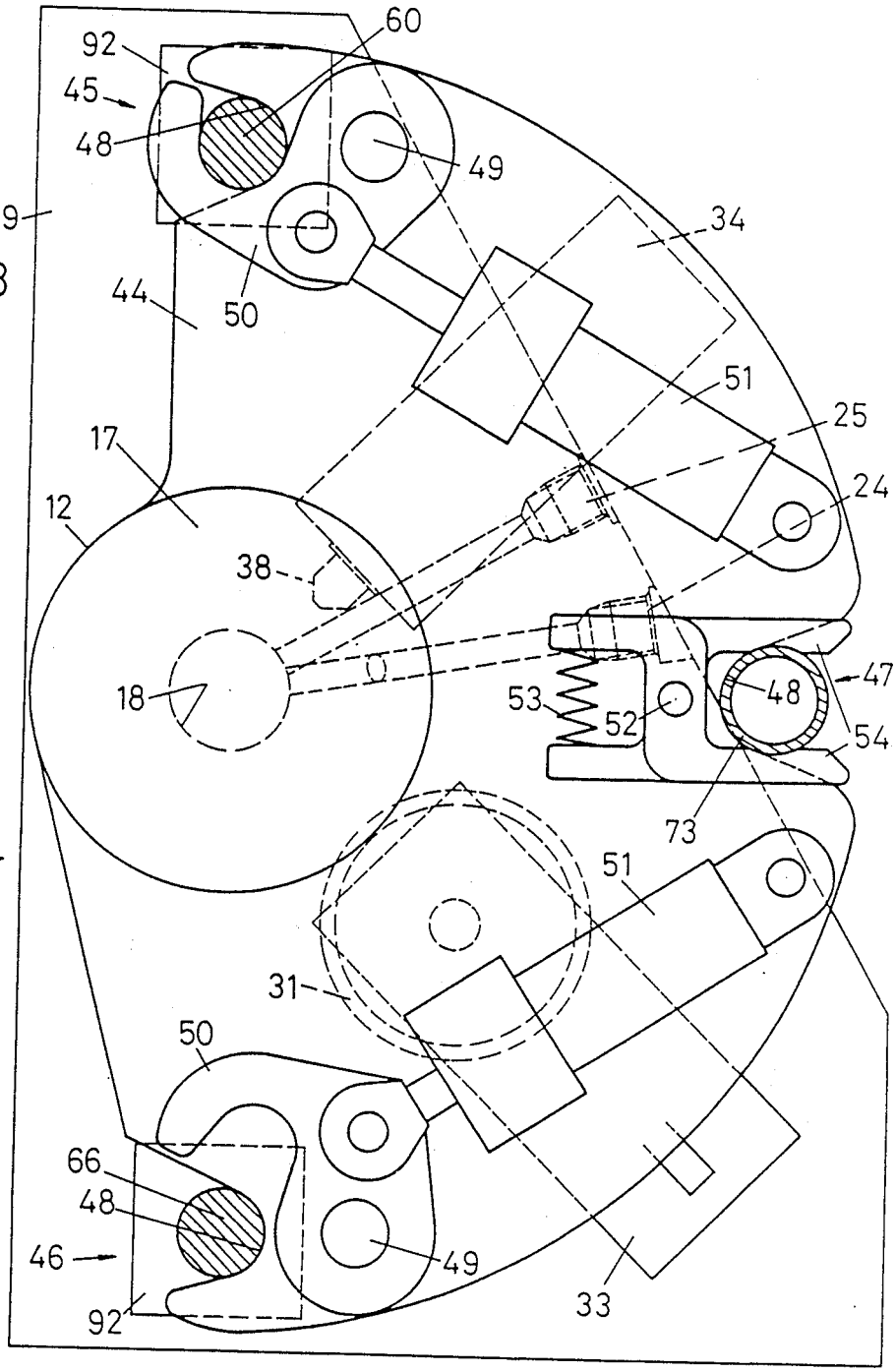
FIG. 3 is a top plan view of the tool exchange device in the anchor driling unit of FIG. 1.

Two identical semi-circular carrier plates 44 are welded onto the outside of jacket tube 12 and each of these carrier plates 44 is provided with a first uptake system 45 for a drill rod 60 and a second uptake system 46 for an anchor rod 66. In addition, also mounted on each of semi-circular carrier plates 44 is a third uptake system 47 that is employed to selectively retain a cartridge injection tube 73. Each of uptake systems 45, 46, and 47 includes a semi-circular recess 48 formed in both plates 44, with recess 48 of uptake system 47 opening radially outwardly and the other two recesses 48 of uptake systems 45, 46 opening tangentially. In the case of drill rod 60 and anchor rod 66, these rods are kept in the appropriate recesses 48 at both semi-circular plates 44 by respective claw levers 50 that are moveable or rotatable about respective pins 49 affixed to the semi-circular carrier plates 44. As shown more clearly in FIG. 3, each claw lever 50 is actuated by a respective hydraulic cylinder 51, which actuates retaining claw 50.

Figure 5:
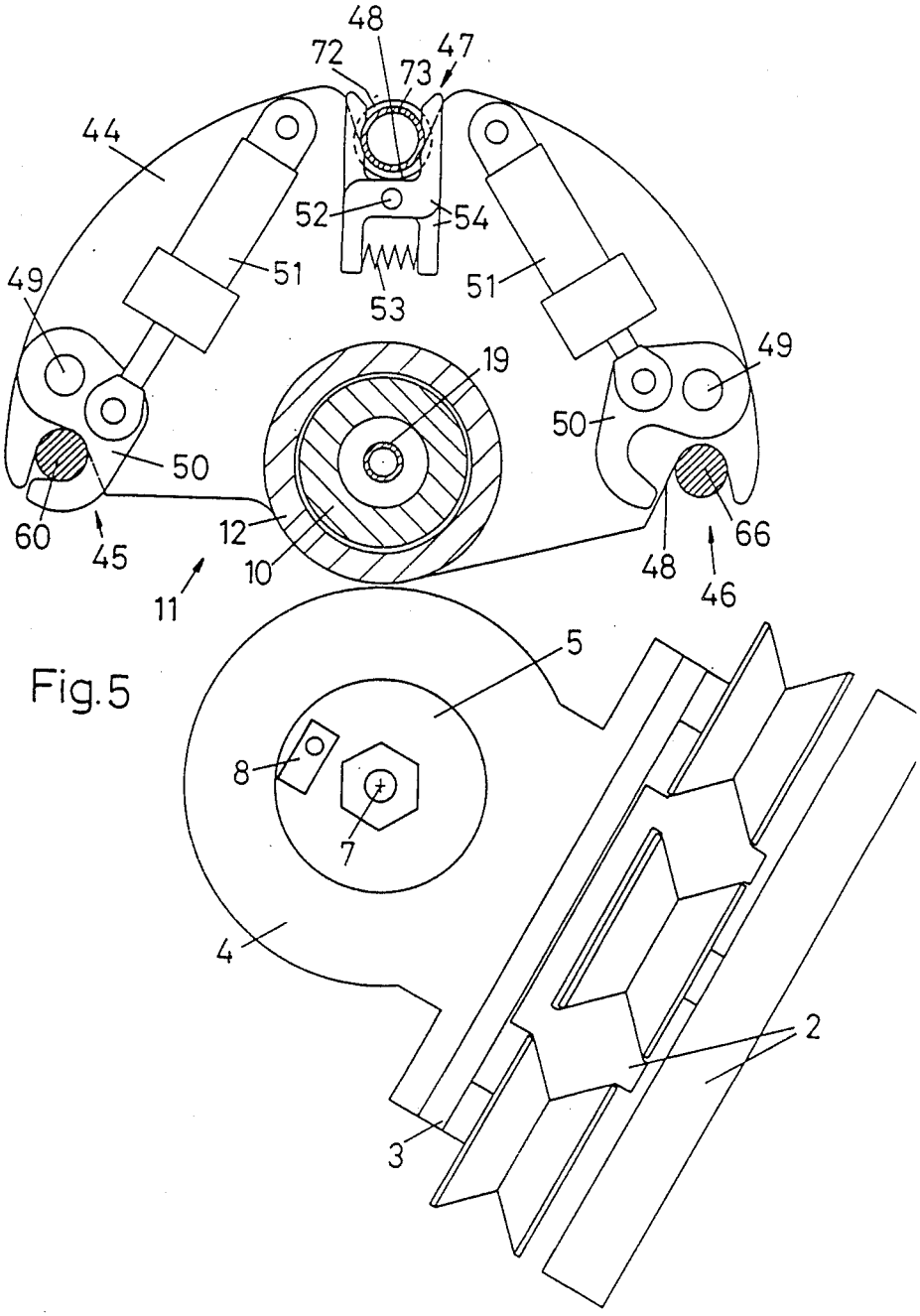
FIG. 5 is a plan view in cross section, taken along section line V—V in FIG. 2.

In FIG. 5, claw lever 50 is represented in the closed position in the case of uptake system 45, whereby it engages and firmly grasps drill rod 60, and claw lever 50 is shown in the open position in uptake system 46 in which anchor rod 66 is completely released. Thus, in this released position, assuming that anchor rod 66 has been instructed in a bore hole in the roof, exchange device 11 can be rotated in a counterclockwise direction and anchor rod 66 can remain in the the roof of the excavation. The pilot or control valves (not shown) that are assigned to the hydraulic cylinder units 51 each have three individual switch positions. More specifically, in a first position, pressure is applied to the piston side of the cylinder 51 and claw lever 50 will be closed to press against either drill rod 60 or anchor rod 66. In the second position, both cylinder spaces of cylinder 51 are connected to the return stroke and claw lever 50 is released but not fully retracted so that anchor rod 66 or drill rod 60 can be moved longitudinally, yet still be guided along a longitudinal path by the inner surface of claw lever 50 and recess 48. In a third position, the rod side of hydraulic cylinder 51 is acted upon and claw lever 50 is swung open thereby releasing drill rod 60 or anchor rod 66 from any contact with claw lever 50.

In the case of uptake system 47, which operates on adhesive cartridge tube 73, two clamp levers 54 are provided that are spring loaded to bear against bearing surfaces on the outside of cartridge tube 73. Clamp levers 54 are moveable about pins 52 respectively affixed to both semi-circular carrier plates 44. A spring 53 provides the clamping action for clamp levers 54, whereby adhesive cartridge tube 73 is held yet can be guided for longitudinal movement. A flange 72 is mounted on the cartridge tube 73 and is located at the lower one of carrier plates 44, as shown in FIG. 7 and FIG. 1.

In the case of anchor rod 66, a sharpened, hardened cutting edge 67 is provided at the upper end thereof for cutting into the adhesive cartridges that have been inserted into the bore hole drill by means of drill rod 60. At the other end of anchor rod 66 is a threaded portion 68 on which a hexagonal nut 69 is threaded. Nut 69 is closed at its lowermost end with a plug (not shown) that acts as a preset breaking point after which the nut can be threaded up further over the length of the threaded portion 68. An anchor plate 70 is arranged at the other side of hexagonal nut 69 and is provided with a convex surface on the side facing the length of anchor bar 66. Chuck 5 of rock drill 4 is provided with a suitable hexagonal bore that cooperates with the outer surface of hexagonal nut 69.

Turning then to drill rod 60, this rod is hollow for the passage of wash water therethrough, as known in other drilling techniques, in order to keep the dust at a minimum. Drill rod 60 has a drill crown or bit 61 at the operable end and a hexagonal drive surface 62 that corresponds to nut 69 for engagement with the hexagonal bore in chuck 5. The lower portion 63 of drill rod 60 is substantially cylindrical and included with an O-ring seal 64 that is below the hex drive 62 so that upon insertion of drill rod 60 into chuck 5, drill rod 60 will be sealingly engaged, so that water fed into water inlet 6 will not leak out around chuck 5.

Figure 7:
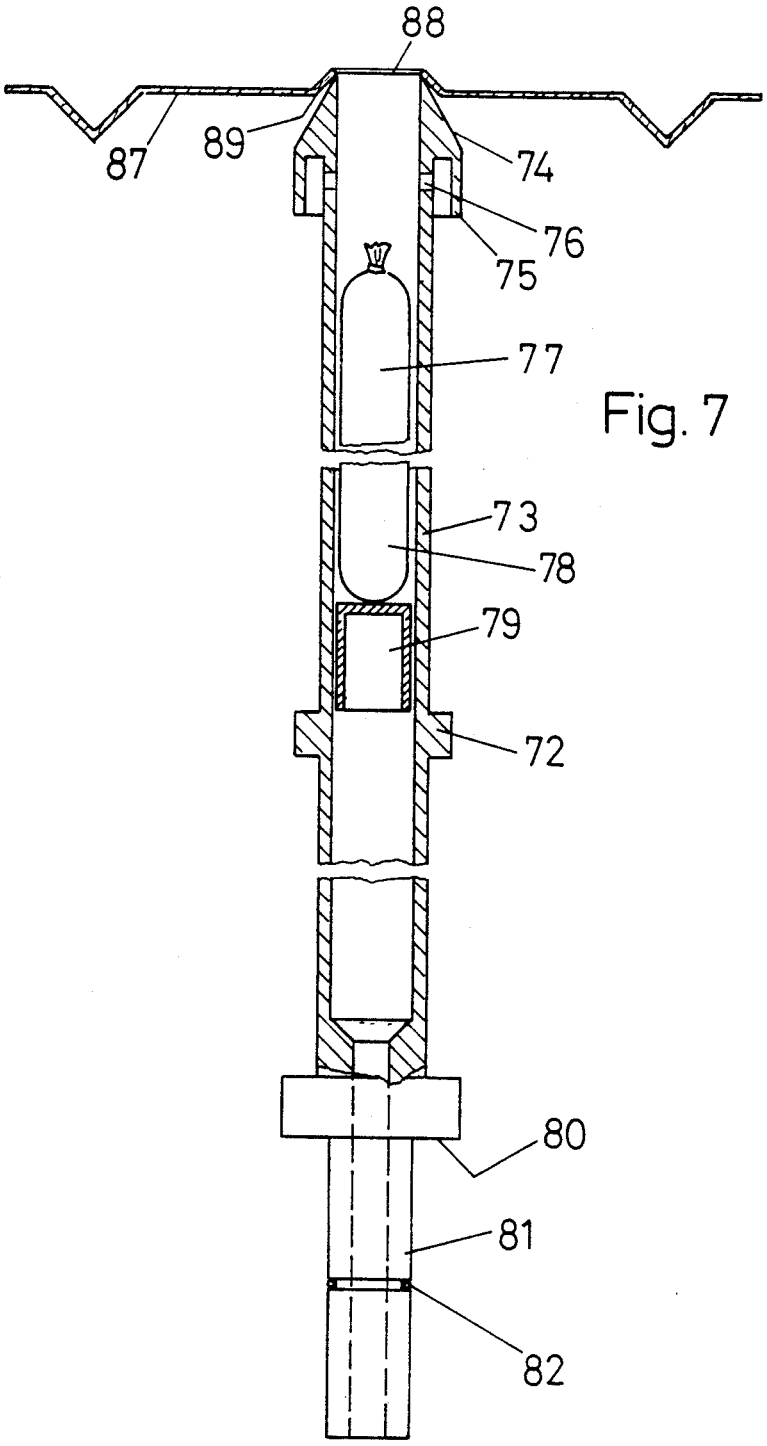
FIG. 7 is an elevational view in cross section through an adhesive cartridge tube in the anchor drilling unit of FIG. 1.

FIG. 7 shows adhesive cartridge tube 73 in further detail and it is seen therein that cartridge tube 73 has a conical attachment 74 at the upper end thereof that includes a cylindrical collar portion that surrounds the end of cartridge tube 73. Weep holes or fluid bleed holes 76 are provided through the wall of cartridge tube 73 and are shielded by the cylindrical collar 75.

As is known, a feature of rock bolts or roof bolts is that they are can be held in the roof of the excavation by adhesive and, particularly, by a two-part resin that hardens only upon mixing of the two separate components. Thus, the two-component adhesive in one or more plastic cartridges 77, 78 is loaded into the adhesive cartridge tube 73. A plastic piston 79 is arranged below cartridges 77, 78 and at its lower end cartridge tube 73 has a shoulder 80 for seating into the base of the inside hexagonal bore in chuck 5. A tubular portion 81 of cartridge tube 73 is below hexagonal portion 80 and is provided with a sealing O-ring 82. Thus, when adhesive cartridge tube 73 is seated into chuck 5, the hexagonal portion 80 will engage the hexagonal bore in chuck 5 and lower portion 81 will be sealingly received in the lower portion of the chuck so that when water is fed into water inlet 6, such water will not leak out around the chuck 5 but will drive piston 79 upwardly.

In operation of the tool exchange device in drill unit according to the present invention, after the demolition machine has been advanced one step, a support plate 87 that includes several through holes 88 is exactly positioned onto the roof 86 of the excavation and is pressed there against. Each hole 88 in the support plate 87 is formed with a conical counter sink or recess 89 and each hole 88 has one of the anchor drilling units assigned to it, so that support plate 87 can be secured to the roof 86 of the excavation in one single operation, as opposed to the sequential operations previously required by the larger cumbersome machines known heretofore. Jacket tube 12 is raised from its lowered position by actuating hydraulic piston 16 and, after moving piston 36 from its radially inward position, tool exchange device 11 is revolved around the outside of rock drill 4, as shown for example in FIG. 5. The precise location for tool exchange device is fixed by deactuating hydraulic cylinder 34 and permitting spring 35 to drive piston rod 37 radially inwardly, thus, causing conical surface 38 to cooperate with one of the triangularly shaped grooves 39 longitudinally formed in cylindrical hollow bearing support 10. Sled 3 is now raised along vertical carriage 2 for introduction of the attachment 63 on drill rod 60 into the bore of chuck 5 of the rock drill 4. Limit switches (not shown) are positioned along carriage 2 and, thus, the position of sled 3 is retained in its upward position. At this point, cylinder 51 of uptake element 45 is released and rock drill 4 is switched on, thereby rotating drill rod 60. At this point, sled 3 is raised so that drill rod 60 being guided by uptake system 45 and centered by recess 89 penetrates into through hole 88 of support plate 87 and commences drilling into the roof 86 of the excavation.

After drilling for a short time, claw levers 50 of uptake system 45 are opened and exchange device 11 turns to its base position, with rock drill 4 continuing to operate drill rod 60. Once bore 85 is successfully formed in roof 86 of the excavation, during which time wash water has been fed in through water inlet 6 and up through hollow drill rod 60, rock drill 4 is stopped and sled 3 moves downwardly on vertical carriage 2 until the point where drill crown 61 just sits in hole 85. At this point, jacket tube 12 is turned and stopped and claw lever 50 of uptake system 45 is released and sled 3 is lowered into an intermediate position determined by the limit switch (not shown). Drill rod 60 is then pulled out of chuck 5 when rock drill 4 is lowered by sled 3 into its lowermost end position.

At such time, jacket tube 12 is turned into a position in which adhesive cartridge tube 73 is coaxially aligned with rock drill axis and rock drill 4 is raised so that the cylindrical end 81 of the cartridge tube 73 is inserted into the bore in chuck 5 and sealed therein by action of O-ring 82. At such point, the conical end 74 is pressed upwardly against concial recess 89 and by interaction of the two conical surfaces 74, 89, cartridge tube 73 is centered in hole 88 in support plate 87. Wash water is then fed in through water inlet 66 and pushes piston 79 upwardly, thereby driving cartridges 77 and 78 into hole 85 that has been bored into the roof 86 of the excavation. By following the teaching of the present invention involving the positioning of resin cartridges 77, 78 using water in place of compressed air as in the known technique, the entry speed of the cartridges into the bore hole 85 can be controlled, because such speeds are lower then those provided by compressed air. Therefore, the danger of prematurely rupturing or damaging the adhesive cartridges is thereby reduced.

The adhesive is a two-part resin that undergoes a chemical change upon the mixture of the two parts and, thus, a premature rupture of the cartridges will be fatal to the desired functioning of this roof bolting system. Following the injection of adhesive cartridges 77, 78 into bore hole 85 sled 3, which carries rock drill 4, is returned to its lower end position.

Indexing cylinder 34 is then opened, that is, the piston rod 37 and conical end 38 are withdrawn in a radially outwardly direction, and jacket tube 12 is rotated by motor 32 to a location in which anchor bar 66 is coaxially aligned with rock drill axis 7. Jacket tube 12 is then locked in this position by deactuating indexing cylinder 34 and permitting spring 35 to cause conical end 38 to fit into a longitudinal groove 39 in cylindrical hollow bearing support 10. Once jacket tube 12 is appropriately rotated, sled 3 bearing rock drill 4 is raised upwardly to an appropriate position, as determined by the limit switch (not shown), and claw levers 50 are released after which sled 3 can be run further up until the upper end of anchor bar 66 is centered in bore hole 85. At such point, claw levers 50 of uptake system 46 are completely opened, and jacket tube 12 can be rotated back into a normal position and lowered into its normal end position by operation of hydraulic piston 16. At such time, rock drill 4 is switched on and sled 3 is raised upwardly thereby inserting anchor rod 66 further into bore hole 85 and causing the hardened cutting edge 67 of anchor rod 66 to pierce the adhesive cartridges 77, 78, which typically have outer containers formed of plastic material. By rotation of the anchor rod, and two components making up the adhesive are mixed, as is required to obtain hardening of the resin. Rock drill 4 is then switched on at a low speed after the hardening of the resin, and nut 69 is rotated on threaded section 68. The lug at the rear end of nut 69 will be ejected as nut 69 is threaded over the length of threaded portion 68 at the end of anchor rod 66. In this fashion, the anchor rod is thereby placed and flange 70 holds support plate 87 against the roof 86 of the tunnel. At such point, sled 3 returns to its lowermost end position.

Figure 6:
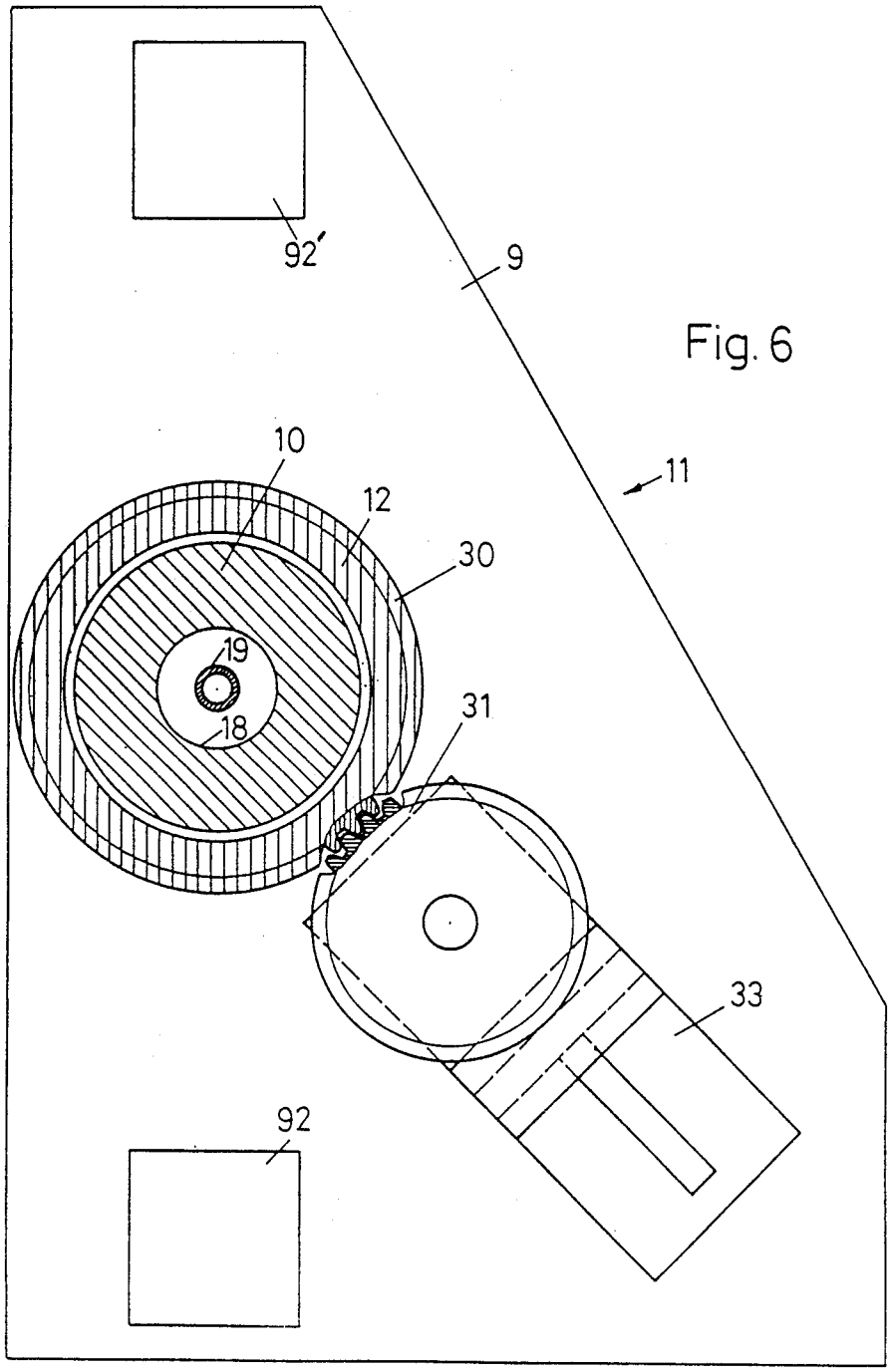
FIG. 6 is a plan view in cross section, taken along section line VI—VI in FIG. 2.

The demolition machine, of which only platform 1 is seen in the present drawings, then advances one step and commences further digging or demolition of the material being removed. At such point, tool exchange device 11 is prepared for the next anchor placement cycle. Such preparation involves introducing a new anchor rod 66 involving nut 69 and anchor plate 70 into the carrier plates 44 at where they are retained by uptake elements 46. In order to obtain an initially correct axial position of a new anchor rod 66 in tool exchange device 11, the lower end of the anchor rod on which nut 69 has been threaded is rested upon a mounting bracket 92, seen in FIGS. 1 and 6, which bracket is fastened to base plate 9 resting upon platform 1 of the demolition machine. Subsequently, the adhesive cartridge tube 73 is also recharged by inserting new adhesive cartridges therein and is again introduced into the appropriate semi-circular recesses of the carrier plates 44 and retained therein by uptake system 47. As a last step, drill crown 61 is checked for damage or wear and drill rod 60 is replaced if necessary. A second bracket 92' similar to bracket 92 is provided on abase plate 9 for axially positioning drill rod 60. Support plate 87 that has been positioned against roof 86 of the gallery is then ready to receive new anchor rods in the next anchor setting cycle and is positioned against roof 86 in the next advance of the demolition machine.

In the situation in which the drilling is being done in rock that does not tolerate wash water, the drilling dust may be vacuumed away and adhesive cartridges 77, 78 can be blown in with compressed air. In which case, it may be advantageous to provide a compressed air attachment at the lower end of cartridge tube 73 whereby attachment end 81 can be eliminated. In addition, if tie bars are to be set instead of the adhesive anchors, such as described above, the entire adhesive cartridge tube 73 can be eliminated.

As an alternative operating procedure from that described above, sled 3 can remain in a lowermost end position in most cases upon introducing attachment 63 of drill rod 60, including nut 69 and anchor 66 into chuck 5. In other words, the jacket tube can be lowered instead of raising the sled and rock drill. This presents some advantage in that a limit switch (not shown) becomes less important and relatively unnecessary on carriage 2. Nevertheless, of course, a more sophisticated control system, that is, a more accurate control system, requiring greater expense costs are necessary relative to controlling the vertical travel of jacket tube 12.

Therefore, by following the teaching of the present invention, the technique of rock bolting is made possible in which automatic anchor placement in roof support plates is performed. The hole is bored in the roof and the anchor rod is placed using the same rock drill and, therefore, both manufacturing and end costs are reduced and, more importantly, the space requirements are minimized because only a single rock drill is provided to accomplish multiple functions. Consequently, several units according to the present invention can be arranged quite closely together in a single machine, thereby reducing the time required for anchoring the support plate. Moreover, by specially fashioning the conical recesses in the support plate and specially forming the operable ends of the anchor drill rod and adhesive cartridge tube to cooperate with this tapered countersink, operation becomes reliable without requiring a manual adjustment each time a new tool is introduced into an opening in the support plate.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. Apparatus for rock bolting in which anchors are fixed to a roof of an underground excavation, comprising:

a rotary rock drill moveable along its axis of rotation;

a tool exchange device for releasably retaining a drill rod for drilling a hole in the roof and an anchor rod for introduction into the hole drilled in the roof;

a chuck mounted in said rock drill and being adaptable for receiving a lower end of said anchor rod and said drill rod;

said tool exchange device including a first uptake element for releasably retaining said drill rod, a second uptake element for releasably retaining said anchor rod, and means for moving said exchange device transversely to at least three positions around said rock drill, in a first position, first and second uptake elements are at a peripheral area of said rock drill, in a second position said first uptake element for said drill rod is coaxial with said axis of rotation of said rock drill and, in a third position, said second uptake element for said anchor rod is coaxial to said axis of rotation of rock drill;

said first and second uptake elements further including a tensioning means operable to a first tension position in which said drill rod and said anchor rod are tightly retained, a second position in which said drill rod and anchor bar are loosely retained for permitting longtitudinal movement thereof; and a third release position in which said drill rod and anchor bar can be moved transversely from said tool exchange device.

2. Apparatus according to claim 1, further comprising means for moving said tool exchange device longitudinally parallel to the axis of rotation of said rock drill.

3. Apparatus according to claim 1, further comprising third uptake elements fixed to said tool exchange device for receiving an adhesive cartridge tube and in which said tool exchange device has a fourth position in which said adhesive cartridge tube is rotated to be coaxial with the axis of rotation of said rock drill.

4. Apparatus according to claim 3, in which said adhesive cartridge tube has a lower end thereof adapted for cooperation with said chuck in said rock drill.

5. Apparatus according to claim 4, in which said third uptake element includes a partial cylindrical recess for longitudinally guiding said adhesive cartridge tube and a catch means for releasably retaining said adhesive cartridge tube introduced in a direction transverse to said recess.

6. Apparatus according to claim 5, further comprising a water connection formed in said rock drill and in said chuck and in which said drill rod is formed as a hollow tube, whereby water is introduced into said drill rod when said drill rod is operably connected to said chuck in said rock drill.

7. Apparatus according to claim 6, in which said adhesive cartridge tube has an open lower end and whereby said water connection is connected with said adhesive cartridge tube when said adhesive cartridge tube is operably connected in said chuck in the fourth position of said tool exchange device.

8. Apparatus according to claim 7, in which said first and second uptake elements each include a claw lever and means for pivotally mounting said claw lever and means for activating said claw lever between at least a released position and a closed position.

9. Apparatus according to claim 8, in which said tool exchange device includes means for rotating said tool exchange device about a rotational axis parallel to the rotational axis of said rock drill and whereby centers of said means for pivotally mounting said claw lowers are equidistance from said rotational axis of said tool exchange device.

10. Apparatus according to claim 2, further comprising third uptake elements fixed to said tool exchange device for receiving an adhesive cartridge tube and in which said tool exchange device has a fourth position in which said adhesive cartridge tube is rotated to be coaxial with the axis of rotation of said rock drill.

11. Apparatus according to claim 10, in which said adhesive cartridge tube has a lower end thereof adapted for cooperation with said chuck in said rock drill.

12. Apparatus according to claim 11, in which said third uptake element includes a partial cylindrical recess for longitudinally guiding said adhesive cartridge tube and a catch means for releasably retaining said adhesive cartridge tube introduced in a direction transverse to said recess.

13. Apparatus according to claim 12, further comprising a water connection formed in said rock drill and in said chuck and in which said drill rod is formed as a hollow tube, whereby water is introduced into said drill rod when said drill rod is operably connected to said chuck in said rock drill.

14. Apparatus according to claim 13, in which said adhesive cartridge tube has an open lower end and whereby said water connection is connected with said adhesive cartridge tube when said adhesive cartridge tube is operably connected in said chuck in the fourth position of said tool exchange device.

15. Apparatus according to claim 13, in which said first and second uptake elements each include a claw lever and means for pivotally mounting said claw lever and means for activating said claw lever between at least a released position and a closed position.

16. Apparatus according to claim 15, further comprising means for rotating said tool exchange device about a rotational axis parallel to the rotational axis of said rock drill and whereby centers of said means for pivotally mounting said claw lowers are equidistance from said rotational axis of said tool exchange device.

17. A system for rock bolting a roof of an underground excavation using anchor rods, comprising:

a support plate having a plurality of through holes therein for receiving the anchor rods, said through holes having a conical countersink;

a rotary rock drill moveable along its axis of rotation;

a tool exchange device for releasably retaining a drill rod for drilling hole in the roof and an anchor rod for introduction into the hole drilled in the roof through one of said plurality of through holes in said support plate;

a chuck mounted in said rock drill and being adaptable for receiving a lower end of said anchor rod and said drill rod;

said tool exchange device including a first uptake element for releasably retaining said drill rod, a second uptake element for releasably retaining said anchor rod, and means for moving said exchange device transversely to at least three positions around said rock drill, in a first position, first and second uptake elements are at a peripheral area of said rock drill, in a second position said first uptake element for said drill rod is coaxial with said axis of rotation of said rock drill and, in a third position, said second uptake element for said anchor rod is coaxial to said axis of rotation of rock drill;

said first and second uptake elements further including a tensioning means selectable to a first tension position in which said drill rod and said anchor rod are tightly retained, a second position in which said drill rod and anchor bar are loosely retained for longitudinal movement; and a third release position in which said drill rod and anchor bar can be moved transversely from said tool exchange device.

18. System according to claim 17, further comprising means for moving said tool exchange device longitudinally parallel to the axis of rotation of said rock drill.

19. System according to claim 18, further comprising third uptake elements fixed to said tool exchange device for receiving an adhesive cartridge tube and in which said tool exchange device has a fourth position in which said adhesive cartridge tube is rotated to be coaxial with the axis of rotation of said rock drill.

20. System according to claim 19, in which said adhesive cartridge tube has a lower end thereof adapted for cooperation with said chuck in said rock drill.

* * * * *